US010253952B2

(12) United States Patent
Yamada

(10) Patent No.: US 10,253,952 B2
(45) Date of Patent: Apr. 9, 2019

(54) LIGHT EMITTING DEVICE HAVING HALF MIRROR WITH LIGHT REFLECTING LAYER

(71) Applicant: NICHIA CORPORATION, Anan-shi (JP)

(72) Inventor: Motokazu Yamada, Tokushima (JP)

(73) Assignee: NICHIA CORPORATION, Anan-shi (JP)

( * ) Notice: Subject to any disclaimer, the term of this patent is extended or adjusted under 35 U.S.C. 154(b) by 0 days.

(21) Appl. No.: 15/889,205

(22) Filed: Feb. 6, 2018

(65) Prior Publication Data

US 2018/0180255 A1 Jun. 28, 2018

Related U.S. Application Data

(63) Continuation of application No. 15/340,990, filed on Nov. 2, 2016, now Pat. No. 9,920,907.

(30) Foreign Application Priority Data

Nov. 4, 2015 (JP) ..... 2015-216997
Jun. 28, 2016 (JP) ..... 2016-127194

(51) Int. Cl.
*F21V 3/00* (2015.01)
*F21V 13/14* (2006.01)
(Continued)

(52) U.S. Cl.
CPC ..... *F21V 13/14* (2013.01); *F21V 3/00* (2013.01); *F21V 3/10* (2018.02); *F21V 3/12* (2018.02); *F21V 5/04* (2013.01); *F21V 7/0083* (2013.01); *F21V 9/08* (2013.01); *F21V 15/01* (2013.01); *F21V 19/005* (2013.01); *F21V 7/22* (2013.01);
(Continued)

(58) Field of Classification Search
CPC ..... H01L 33/465; H01L 33/504
See application file for complete search history.

(56) References Cited

U.S. PATENT DOCUMENTS 6,532,048 B1 3/2003 Matsui
2007/0159573 A1 7/2007 Lee et al.
(Continued)

FOREIGN PATENT DOCUMENTS

JP 2005-352426 12/2005
JP 2006-310042 11/2006
(Continued)

OTHER PUBLICATIONS

Notice of Allowance with Form PTO-892 Notice of References Cited issued by the United States Patent and Trademark Office for the parent U.S. Appl. No. 15/340,990, filed Nov. 7, 2017.

*Primary Examiner* — Joseph L Williams
(74) *Attorney, Agent, or Firm* — Mori & Ward, LLP

(57) ABSTRACT

A light emitting device includes a base, light sources, wall portions, and a half mirror. The base has a light reflecting surface and has a first side on which the light reflecting surface is provided. The light sources are mounted on the first side of the base. Each of the wall portions surrounds each of the plurality of light sources. The half mirror is to reflect a part of incident light and to transmit another part of the incident light. The half mirror is disposed opposite to the base such that the light sources are provided between the half mirror and the base.

20 Claims, 8 Drawing Sheets

(51) Int. Cl.

| | |
|---|---|
| ***F21V 19/00*** | (2006.01) |
| ***F21V 7/00*** | (2006.01) |
| ***F21V 9/08*** | (2018.01) |
| ***F21V 5/04*** | (2006.01) |
| ***F21V 15/01*** | (2006.01) |
| ***F21V 3/10*** | (2018.01) |
| ***F21V 3/12*** | (2018.01) |
| *F21V 7/22* | (2018.01) |
| *F21Y 115/10* | (2016.01) |
| *F21Y 113/13* | (2016.01) |
| *F21V 9/30* | (2018.01) |

(52) U.S. Cl.
CPC ..... *F21V 9/30* (2018.02); *F21Y 2113/13* (2016.08); *F21Y 2115/10* (2016.08)

(56) References Cited

U.S. PATENT DOCUMENTS

| | | | |
|---|---|---|---|
| 2007/0159843 | A1 | 7/2007 | Choi |
| 2007/0279937 | A1 | 12/2007 | Hsiao et al. |
| 2008/0192174 | A1 | 8/2008 | Odake et al. |
| 2010/0214762 | A1 | 8/2010 | Nevitt et al. |
| 2011/0121321 | A1 | 5/2011 | Kato et al. |
| 2012/0105764 | A1 | 5/2012 | Yokota |
| 2015/0009649 | A1 | 1/2015 | Jagt et al. |
| 2017/0317241 | A1* | 11/2017 | Kim ..... H01L 33/465 |

FOREIGN PATENT DOCUMENTS

| | | |
|---|---|---|
| JP | 2007-188035 | 7/2007 |
| JP | 2007-188886 | 7/2007 |
| JP | 2008-004961 | 1/2008 |
| JP | 2009-152142 | 7/2009 |
| JP | 2010-529592 | 8/2010 |
| JP | WO2010/146915 | 12/2010 |
| JP | 2012-174371 | 9/2012 |
| JP | 2012-212509 | 11/2012 |
| JP | 2014-153513 | 8/2014 |
| JP | 2014-528148 | 10/2014 |
| JP | 2014-211596 | 11/2014 |

* cited by examiner

LIGHT EMITTING DEVICE HAVING HALF MIRROR WITH LIGHT REFLECTING LAYER

CROSS-REFERENCE TO RELATED APPLICATIONS

The present application is a continuation application of the U.S. patent application Ser. No. 15/340,990 filed Nov. 2, 2016, which claims priority under 35 U.S.C. § 119 to Japanese Patent Application No. 2015-216997, filed Nov. 4, 2015, and Japanese Patent Application No. 2016-127194, filed Jun. 28, 2016. The contents of these applications are incorporated herein by reference in their entirety.

BACKGROUND OF THE INVENTION

Field of the Invention

The present disclosure relates to a light emitting device.

Discussion of the Background

In recent years, various electronic components have been proposed and put to practical use, and the performance required of these electronic components has also been increasing. Particularly, the electronic components have been required to maintain long term performance even under a severe use environment. Such a requirement is also directed to light emitting devices including a semiconductor light emitting element such as a light emitting diode (LED). That is, in the fields of general lighting and in-vehicle lighting, the performance required of the light emitting devices is increasing every day, and further high output (high brightness) and high reliability are required. Furthermore, supply in low price is also required while such high performance is maintained.

Particularly in backlights used for liquid crystal televisions, general lighting devices, and the like, good design is highly recommended, demands for smaller thickness is particularly high, and further, manufacturing of such products at the lowest possible cost, have become important tasks.

For example, Japanese Unexamined Patent Application Publication No. 2012-174371 and Japanese Unexamined Patent Application Publication No. 2012-212509 disclose a method of thinning a direct-type backlight by combining a reflecting plate with a half mirror having the reflectance partially controlled.

SUMMARY OF THE INVENTION

According to one aspect of the present invention, a light emitting device includes a base, light sources, wall portions, and a half mirror. The base has a light reflecting surface and has a first side on which the light reflecting surface is provided. The light sources are mounted on the first side of the base. Each of the wall portions surrounds each of the plurality of light sources. The half mirror is to reflect a part of incident light and to transmit another part of the incident light. The half mirror is disposed opposite to the base such that the light sources are provided between the half mirror and the base.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE EMBODIMENTS

Figure 1:
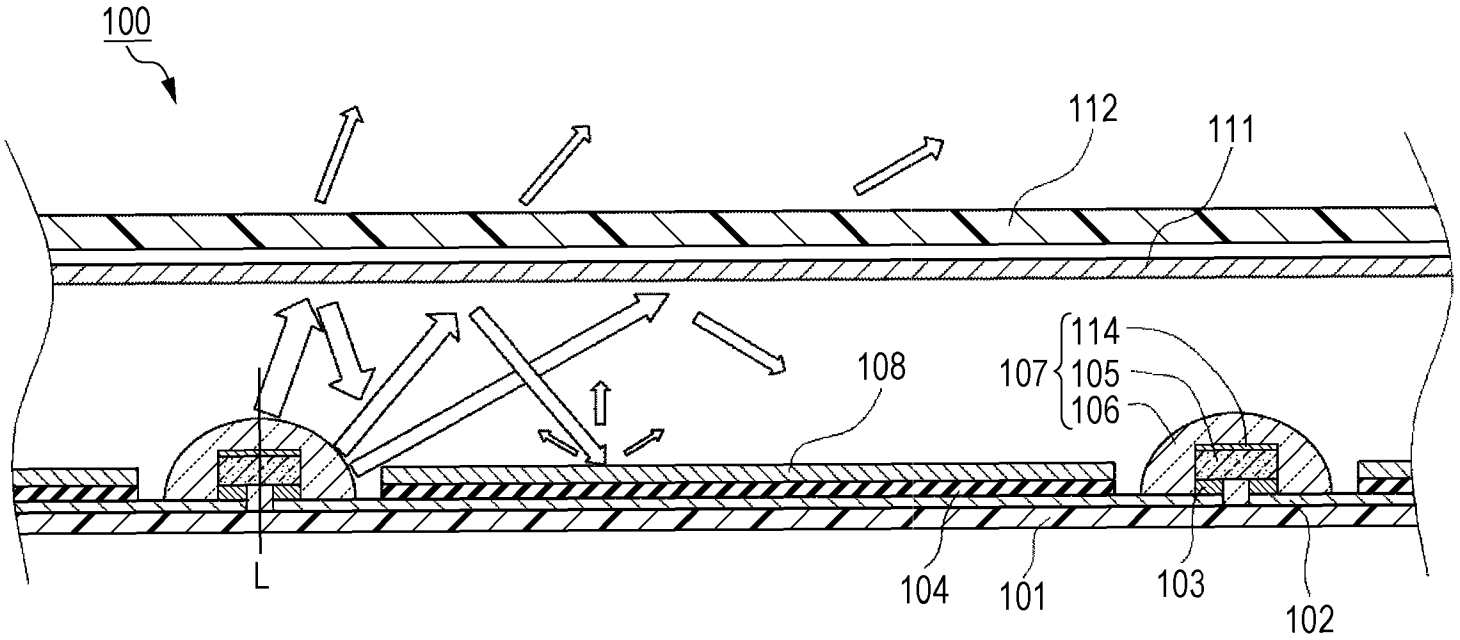
FIG. 1 is a schematic sectional view illustrating an example of a light emitting device according to a first embodiment.

The embodiments will now be described with reference to the accompanying drawings, wherein like reference numerals designate corresponding or identical elements throughout the various drawings.

Hereinafter, embodiments of the present invention are described with appropriate reference to the drawings. However, light emitting devices described below are ones for embodying technical ideas, and the present invention is not limited to the following light emitting devices unless otherwise specified. Further, the contents described in one embodiment and one working example can also be applied to another embodiment and another working example.

In the description below, the same designations or the same reference numerals denote the same or like members and detailed descriptions will be appropriately omitted. In addition, a plurality of structural elements according to the embodiments of the present invention may be configured as a single member which serves the purpose of a plurality of members, on the other hand, a single structural member may be configured as a plurality of members which serve the purpose of the single member. In the specification, it is understood that when an element such as a layer, region or substrate is referred to as being "on" another element, it can be directly or indirectly on the other element. That is, it may be directly connected to the other element, or it may be connected to the other element via at least one intervening element.

First Embodiment

FIG. 1 is a schematic structural view illustrating an example of a light emitting device according to a first embodiment.

As illustrated in FIG. 1, a light emitting device 100 according to the present embodiment includes a base 101, and a light source 107 electrically connected to a pair of conductor wiring lines 102 provided on a surface of the base, with a bonding member 103 interposed between the light source 107 and the pair of conductor wiring lines 102. The light source of the present embodiment includes a light emitting element 105 and a sealing member 106 that covers the light emitting element 105. The arrows in FIG. 1 indicate main light rays.

A plurality of light sources 107 are disposed in a spaced apart manner on the base 101, and the base 101 includes thereon a light diffusing member 108 as a light reflecting surface (a light reflecting layer) except at least parts directly under the light sources disposed. This light diffusing member is, for example, sheet-shaped, and increases the light reflectance of the surface of the base to improve the light emission efficiency of the light emitting device 100. The light diffusing member not only increases the light reflectance but also has an effect of scattering light to further reduce the brightness unevenness for observation from a side of a light diffusing plate 112 described below.

The light emitting device 100 also includes a half mirror 111 on a side of a light extraction surface opposite to the base 101 with the light source 107 interposed therebetween, the half mirror 111 is configured to reflect a part of the incident light and transmitting another part of the incident light from the light source 107. The half mirror 111 preferably has incident angle dependence of reflectance for a light emission wavelength of the light source 107. The light diffusing plate 112 is disposed above the half mirror 111.

The half mirror 111 has a high reflectance for a light ray emitted in an optical axis direction among the light rays emitted from the light source 107. As an emission angle to the optical axis of the light source 107 increases, the light reflectance preferably decreases so that the amount of light transmitted through the half mirror increases. That is, the reflectance of the half mirror 111 is preferably set to be lower in oblique incidence than in vertical incidence. With this configuration, a uniform brightness distribution having improved brightness unevenness can be easily obtained for observation from the light diffusing plate 112 side.

Each of the light sources 107 preferably has batwing light distribution characteristics. With this configuration, the amount of light output in a direction directly above the light source 107 is reduced to widen the light distribution of the light source so that the brightness unevenness can be further improved.

In the present specification, in its broader definition, the batwing light distribution characteristics have a light emission intensity distribution having strong light emission intensity at angles of light distribution with greater absolute values than 0° with an optical axis L set as 0°. In its narrower definition, the batwing light distribution characteristics have a light emission intensity distribution having the strongest light emission intensity at an angle near absolute values of 45° to 90°. That is, a central portion is darker than an outer peripheral portion in the batwing light distribution characteristics.

Hereinafter, a preferable form of the light emitting device 100 according to the present embodiment will be described.

Half Mirror 111

The half mirror 111 is disposed on the light extraction surface side of each of the light sources 107.

The half mirror 111 preferably has a dielectric multilayer film structure in which insulating films having different refractive indexes are layered on a light-transmissive base substrate. As a specific material of the insulating films, materials such as a metal oxide film, a metal nitride film, a metal fluoride film, and an organic material are preferable, which exhibit less light absorption of a light having wavelengths which a light emitted from the light source 107 and a light emitted from a wavelength converting member 113 described below have.

Use of the dielectric multilayer film can give a reflecting film having less light absorbency. In addition, designing of a film enables not only adjustment of the reflectance to any level, but also a control of the reflectance according to the angle. Particularly, by setting the reflectance lower in oblique incidence than in vertical incidence, the reflectance can be increased at a portion in the vertical direction (optical axis) to the light extraction surface, and can be decreased at a portion having a large angle to the optical axis. That is, by increasing the transmittance at a portion having a large angle to the optical axis, the brightness unevenness on the surface can be further decreased as observed from the side of the light diffusing plate 112 described below.

Figure 3:
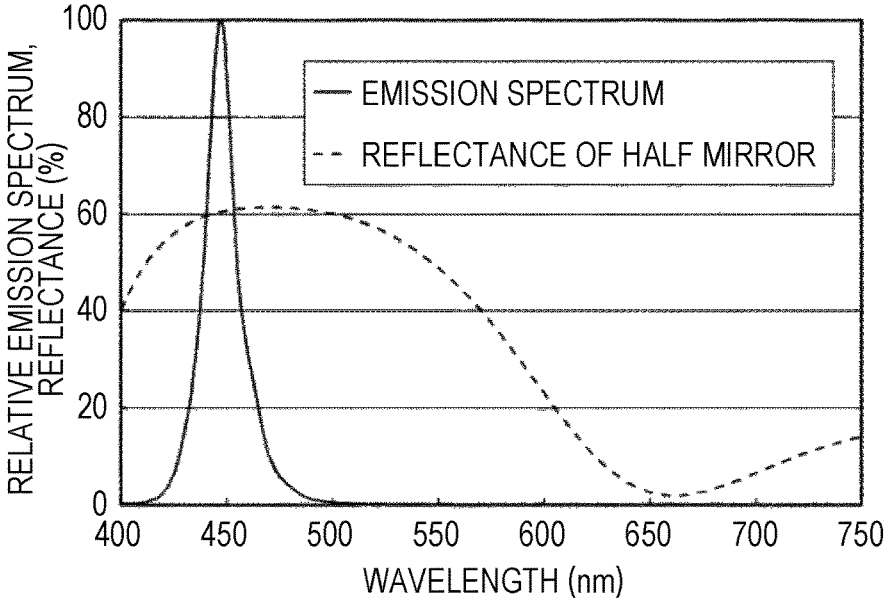
FIG. 3 is a graph illustrating the relationship between the wavelength band of a half mirror and the light emission wavelength of a light emitting element in the embodiment.

In particular, as illustrated in FIG. 3, it is useful to make wider a first wavelength range in which a wavelength is more than or equal to the light emission peak wavelength of the light source 107 and in which a reflectance of the half mirror 111 is larger than a reflectance threshold (e.g. 60%) than a second wavelength range in which a wavelength is less than or equal to the light emission peak wavelength of the light source 107 and in which the reflectance of the half mirror is larger than the reflectance threshold. This is because the wavelength range in which the reflectance of the half mirror is larger than the reflectance threshold is shifted to the short wavelength side with an increasing angle to the optical axis, and by making the first wavelength range wider on the long wavelength side with respect to the light emission wavelength, the reflectance can be maintained up to a wide angle side.

The reflectance of the half mirror 111 at the vertical incidence is preferably 30 to 75% in a range of the light emission wavelength of the light source 107. A low reflectance lower than 30% deteriorates the effect of reflecting light to the side of the light reflecting surface described below, and a reflectance higher than 75% remarkably deteriorates the brightness.

According to the present embodiment, the space between the half mirror 111 and the base 101 can be narrowed while the brightness unevenness is reduced, and for example the space between the half mirror 111 and the base 101 can be set to 0.3 times or lower the space between light sources of the plurality of light sources 107.

Light Diffusing Member 108

It is preferable to form a material of the light diffusing member 108 by adding, to a base material having less light absorbency for the light emitted from the light source 107 and the wavelength converting member 113 described below, a material having less light absorbency as with the base material and having a refractive index different from that of the base material. The material having a different refractive index includes a gas. As described above, the light diffusing member 108 is a member used for forming the light reflecting surface, and the reflection on the surface of the light diffusing member is diffuse reflection (irregular reflection).

The light reflected by the half mirror 111 and returned to the base 101 side is reflected on a surface of the light diffusing member 108 as a reflecting surface and reenters the half mirror 111. By repeating these procedures, the brightness unevenness is reduced.

Light Source 107

As the light source 107, it is preferable to use a light emitting diode (LED). For power input to the light source 107, the light source 107 is electrically connected to the conductor wiring line 102 with the bonding member 103. In FIG. 1, an electrode of the light emitting element 105 constituting the light source 107 is flip-chip mounted on the conductor wiring line 102 on the surface of the base 101 with the bonding member 103 interposed between the electrode and the conductor wiring line 102, and a surface opposite to the surface of the base on which the electrode is formed, i.e., a main surface of the light-transmissive substrate is set to be the light extraction surface. The light emitting element 105 is disposed so as to straddle two conductor wiring lines 102 insulatingly separated into a positive electrode and a negative electrode, and is electrically connected to the conductor wiring lines by the bonding member 103 having conductivity to be mechanically fixed. The mounting method of the light emitting element 105 includes, in addition to a mounting method in which soldering paste is used, a mounting method in which a bump is used, for example.

As the light source 107, there may be used one in which a light emitting element is mounted in a package having a reflector on a side surface side of the light emitting element, or may be used a bare chip (light emitting element 105) not covered with a resin. In addition, a primary lens or a secondary lens may be provided to enable wide distribution of the light from the light emitting element.

Particularly, for a light source having batwing light distribution characteristics, it is preferable to use the light emitting element 105 having a reflecting layer 114 on an upper surface thereof for further thinning of the light emitting device.

For example, as illustrated in FIG. 1, the reflecting layer 114 is formed on the light emitting element 105 on the light extraction surface side (upper surface of the light emitting element 105). The reflecting layer may be a metal film or a dielectric multilayer film. With this configuration, light in a direction above the light emitting element 105 is reflected by the reflecting layer 114 so that the amount of light directly above the light emitting element 105 is reduced to give batwing light distribution characteristics. Alternatively, a light source having batwing light distribution characteristics may be obtained by covering the light emitting element 105 with a sealing member and covering an upper surface of the sealing member with a reflecting layer.

Further, as illustrated in FIG. 1, the light emitting element 105 may be covered with the sealing member 106 having light transmissivity. The sealing member 106 protects the light emitting element 105 from an external environment and optically controls the light emitted from the light emitting element, and therefore the sealing member 106 is disposed on the base to cover the light emitting element 105. The sealing member 106 formed in a substantially dome shape covers the light emitting element 105 with the reflecting layer 114 attached thereto, a surface of the conductor wiring line 102 on lateral side surfaces of the light emitting element 105, and a bonding portion, including the bonding member 103, between the light emitting element 105 and the conductor wiring line 102. That is, an upper surface and side surfaces of the reflecting layer 114 are in contact with the sealing member 106, and side surfaces of the light emitting element 105 not covered with the reflecting layer 114 are also in contact with the sealing member 106. Alternatively, the bonding portion may be covered with an underfill material used apart from the sealing member 106. In this case, the sealing member 106 is formed to cover an upper surface of the underfill material and the light emitting element. In the present embodiment, the light emitting element 105 is directly covered with the sealing member 106 as illustrated in FIG. 1.

FIG. 1 illustrates an example of a configuration in which one light emitting element 105 constitutes one light source 107, however, one light source may be configured to include a plurality of light emitting elements 105.

It is preferable that the plurality of light sources 107 can be driven independently of each other and a dimming control (e.g., local dimming and HDR) for each of the light sources be available.

Light Emitting Element 105

A common light source can be used as the light emitting element 105 which is used as a light source. In the present embodiment, however, a light emitting diode is preferably used as the light emitting element 105.

Any wavelength can be selected for the light emitting element 105. For example, as a blue or green light emitting element, there can be used a ZnSe semiconductor, a nitride semiconductor ($In_XAl_YGa_{1-X-Y}N$, $0 \leq X$, $0 \leq Y$, $X+Y \leq 1$), or one including GaP. Further, as a red light emitting element, GaAlAs, AlInGaP, or the like can be used. In addition, a semiconductor light emitting element formed of a material other than the materials described above can also be used. The composition, the light emission color, and the size of a light emitting element to be used, the number of light emitting elements, and the like can be appropriately selected according to the purpose.

Various light emission wavelengths can be selected by the material of a semiconductor layer and the mixture crystallinity thereof. The light emitting element may include positive and negative electrodes on the same surface side or on different surfaces.

The light emitting element 105 of the present embodiment includes a light-transmissive substrate and a semiconductor layer stacked on the substrate. In this semiconductor layer, an n-type semiconductor layer, an active layer, and a p-type semiconductor layer are formed in this order, and an n-type electrode is formed in the n-type semiconductor layer and a p-type electrode is formed in the p-type semiconductor layer.

For a light emitting device including the wavelength converting member, as described below, the nitride semiconductor ($In_XAl_YGa_{1-X-Y}N$, $0 \leq X$, $0 \leq Y$, $X+Y \leq 1$) is preferably used, which can emit light having a short wavelength capable of efficiently exciting the wavelength converting member 113.

Sealing Member 106

As a material for the sealing member 106, light-transmissive materials can be used, such as an epoxy resin, a silicone resin, a mixture resin of an epoxy resin and a silicone resin, and glass. Among these materials, it is preferable to select the silicone resin in view of light resistance and easy molding.

The sealing member 106 can also contain, in addition to a light diffusing material, a wavelength converting member, such as a fluorescent material, which absorbs the light from the light emitting element 105 and emits light having a wavelength different from that of the light emitted from the light emitting element, and a coloring agent in accordance with a light emission color of the light emitting element.

The sealing member 106 can be formed to cover the light emitting element 105 by compression molding or injection molding. Besides, the viscosity of a material for the sealing member 106 is optimized to conduct dropping or drawing on the light emitting element 105, making it possible to control the shape of the sealing member by surface tension of the material itself. The latter forming method does not need a mold so that the sealing member can be formed by a simpler method. As a technique of adjusting the viscosity of a material of the sealing member in such a forming method, the intrinsic viscosity of the material can be used together with the light diffusing material, the wavelength converting member, and the coloring agent described above, to obtain a desired viscosity by adjustment.

Base Member 101

The base 101 is a member on which the light source 107 is mounted. The base 101 includes on the surface thereof the conductor wiring line 102 for supplying power to the light source 107 (light emitting element 105).

Examples of the material for the base 101 include ceramics and resins such as a phenol resin, an epoxy resin, a polyimide resin, a BT resin, polyphthalamide (PPA), and polyethyleneterephthalate (PET). Among the materials, it is preferable to select these resins as the material for the base from the viewpoint of low costs and easy molding. The thickness of the base can be appropriately selected, and the base may be either a flexible substrate that can be produced by a roll-to-roll method, or a rigid substrate. The rigid substrate may be a bendable thin rigid substrate. Alternatively, it is preferable to select the ceramics as the material for the base 101 to give a light emitting device excellent in heat resistance and light resistance.

Examples of the ceramics include alumina, mullite, forsterite, glass ceramics, nitrides (e.g., AlN) and carbides (e.g., SiC), and LTCC.

Further, when a resin is used as the material constituting the base 101, a glass fiber and/or inorganic fillers such as SiO2, TiO2, and Al2O3 can be mixed in the resin to, for example, improve the mechanical strength, reduce the coefficient of thermal expansion, and improve the light reflectance. The base 101 suffices if it can insulatingly separate the pair of conductor wiring lines 102 into each line, and a so-called metal substrate may be used, in which an insulating layer is formed on a metal member.

Conductor Wiring Line 102

The conductor wiring line 102 is a member that is electrically connected to an electrode of the light source 107 (light emitting element 105) and supplies a current (power) from the outside to the light source. That is, the conductor wiring line has a role as an electrode or a part of an electrode for electrification from the outside. Generally, the conductor wiring line is formed into at least two spaced apart electrodes, i.e., a positive electrode and a negative electrode.

The conductor wiring line 102 is framed on at least an upper surface of the base, i.e., a surface on which the light source 107 is mounted. The material for the conductor wiring line 102 can be appropriately selected according to the material to be used as the base 101, the production method, and the like. For example, when ceramics are used as the material for the base 101, a material having a high melting point is preferable as the material for the conductor wiring line 102 so that the material is capable of enduring a firing temperature of a ceramic sheet, and it is preferable to use a metal having a high melting point, such as tungsten and molybdenum. Further, the material for the conductor wiring line may be covered thereon with another metal material such as nickel, gold, or silver by plating, sputtering, vapor deposition, or the like.

When a glass epoxy resin is used as the material for the base 101, an easily processable material is preferable as the material for the conductor wiring line 102. The conductor wiring line 102 can be formed on one or both of the surfaces of the base by a method such as vapor deposition, sputtering, or plating. A metal foil may be attached by pressing. A wiring portion can be patterned into a prescribed shape by masking according to a printing method, photolithography, or the like, followed by an etching process.

Bonding Member 103

The bonding member 103 is a member for fixing the light source 107 to the base 101 or the conductor wiring line 102. Examples of the bonding member 103 include an insulating resin and an electrically conductive member. In the case of flip-chip mounting as illustrated in FIG. 1, the electrically conductive member is used. Specific examples of the electrically conductive member include an Au-containing alloy, an Ag-containing alloy, a Pd-containing alloy, an In-containing alloy, a Pb—Pd-containing alloy, an Au—Ga-containing alloy, an Au—Sn-containing alloy, a Sn-containing alloy, a Sn—Cu-containing alloy, a Sn—Cu—Ag-containing alloy, an Au—Ge-containing alloy, an Au—Si-containing alloy, an Al-containing alloy, a Cu—In-containing alloy, and a mixture of a metal and flux.

As the bonding member 103, one in a liquid, paste or solid state (sheet-shaped, block-shaped, powdered or wire-shaped) can be used, and the state of the bonding member can be appropriately selected according to the composition of the bonding member, the shape of the base, and the like. The bonding member 103 may be formed of a single member or may be formed of several members in combination. When the bonding member 103 does not simultaneously serve for electrical connection to the conductor wiring line 102, a wire may be used, apart from the fixation, to electrically connect an electrode of the light emitting element 105 to the conductor wiring line 102.

Insulating Member 104

It is preferable that the conductor wiring line 102 be covered with an insulating member 104 except a part electrically connected to the light source 107, i.e., the light emitting element 105, and another material. That is, as illustrated in FIG. 1, a resist may be disposed on the base 101 to insulatingly cover the conductor wiring line 102, or the insulating member 104 can be functioned as a resist.

Disposition of the insulating member 104 not only achieves insulation of the conductor wiring line 102 but is also capable of increasing the light extraction efficiency of the light emitting device 100 by containing a white color-based filler to prevent light leakage and absorption.

The material for the insulating member 104 is not particularly limited as long as it is a material having less absorbency for the light from the light emitting element, and is insulating. Examples of the material include epoxy, silicone, modified silicone, a urethane resin, an oxetane resin, acrylic, polycarbonate, and a polyimide.

Light Diffusing Plate 112

The light diffusing plate 112 has an effect of transmitting the light emitted from the plurality of light sources 107 while more diffusing the light, to reduce the brightness unevenness.

The material that forms the light diffusing plate 112 suffices if it is a material having less light absorbency for visible light, and examples thereof include a polycarbonate resin, a polystyrene resin, an acrylic resin, and a polyethylene resin. As a method of diffusing light, a method of incorporating into the light diffusing plate, materials having different refractive indexes may be used, or light may be scattered by processing the shape of a surface of the light diffusing plate.

Second Embodiment

Figure 5:
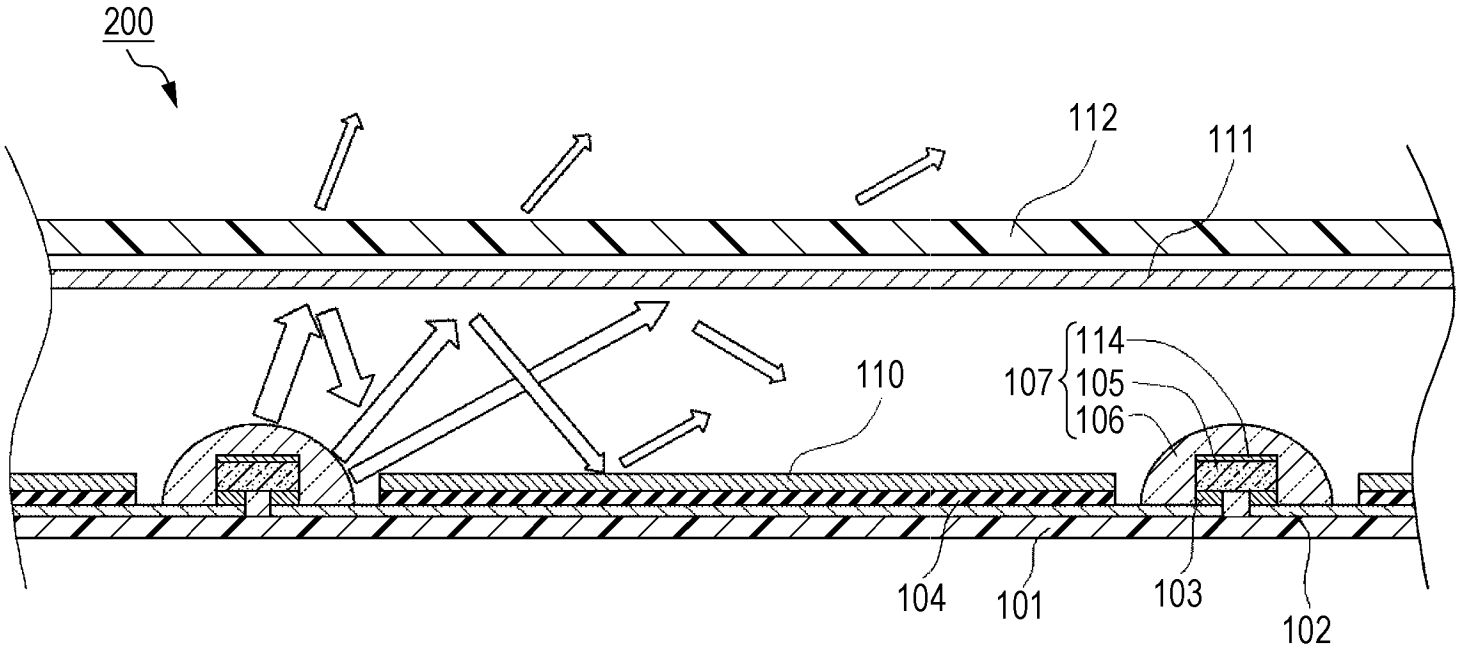
FIG. 5 is a schematic sectional view illustrating an example of a light emitting device according to a second embodiment.

FIG. 5 is a schematic sectional view illustrating an example of a light emitting device 200 according to a second embodiment.

The present embodiment is the same as the first embodiment except that the light diffusing member 108 as a light reflecting surface (a light reflecting layer) in the first embodiment is changed to a mirror 110.

Mirror 110

The mirror 110 directly reflects the light emitted from the light source 107 or reflects the light reflected by the half mirror 111 and returned to the base 101 side. Disposition of the mirror 110 increases light rays of specular reflection compared to the case of using the light diffusion member 108, and enables widening the light emitted from the light source 107 farther from the light source 107 while allowing the light to keep strong light intensity. As a result, it becomes possible to narrow the distance between the base 101 and the half mirror 111.

As a material for the mirror 110, it is possible to use a metal film, but it is preferable to use a dielectric multilayer film. The dielectric multilayer film is preferable because it has less absorption loss, and disposition of an electrically conductive metal film near the light source 107 or the conductor wiring line 102 may cause an electrical short circuit. The thickness of the dielectric multilayer film formed on a surface of the light reflecting surface is preferably 0.3 mm or less. A thickness larger than 0.3 mm causes shielding of the light from the light source by a section of the dielectric multilayer film so that the light does not reach on a wide angle side.

Third Embodiment

Figure 7:
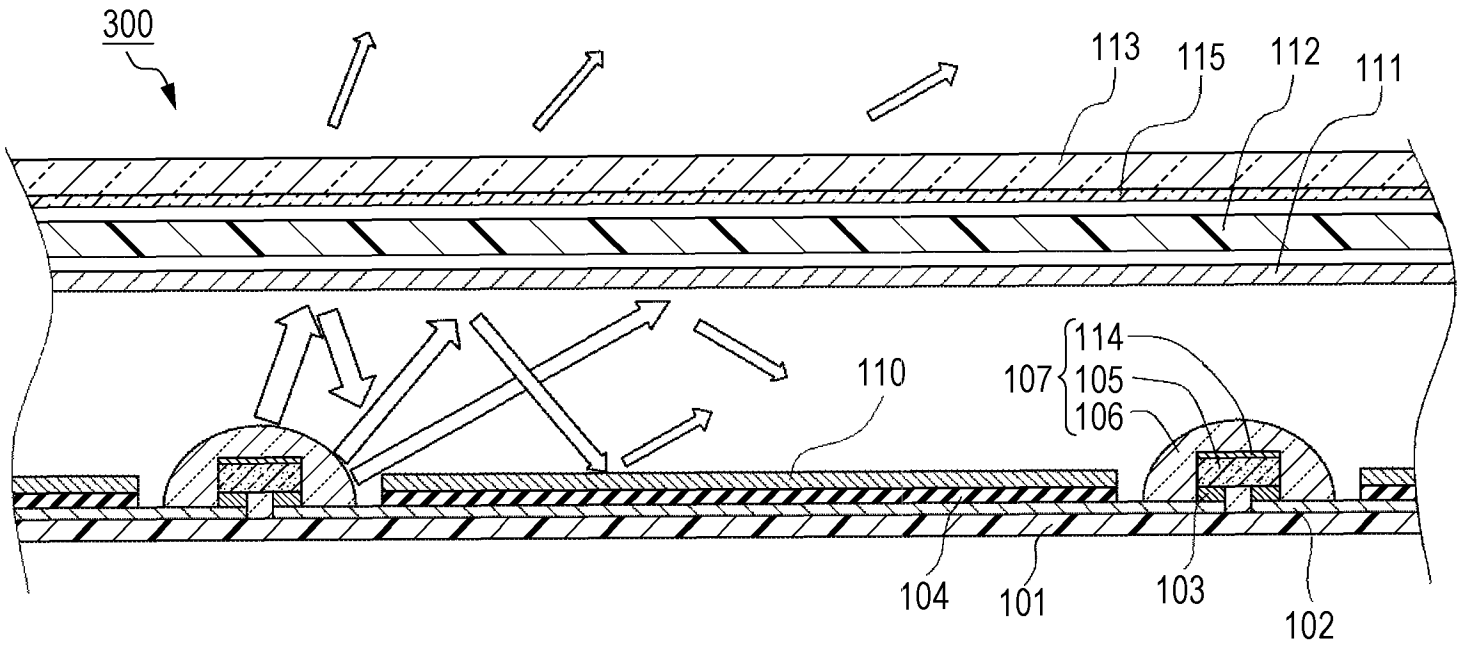
FIG. 7 is a schematic sectional view illustrating an example of a light emitting device according to a third embodiment.

FIG. 7 is a schematic sectional view illustrating an example of a light emitting device 300 according to a third embodiment. The light emitting device 300 is the same as the light emitting device 200 in the second embodiment except that it has a structure in which the wavelength converting member 113 is disposed on the light extraction surface side of the light diffusing plate 112 in the light emitting device according to the second embodiment.

Such a configuration allows, with the light source 107 set as blue light, the wavelength converting member 113 to generate green and red colors necessary as a backlight.

Wavelength Converting Member 113

The advantages of using the wavelength converting member 113 are that the performance as a backlight can be improved because a light conversion substance can be used, which is inferior in resistance against heat and light intensity and whose use is difficult in the vicinity of the light source 107. As the wavelength converting member, for example, a sheet-shaped member can be suitably used.

The material for the wavelength converting member 113 can be formed by, for example, coating, with a wavelength conversion substance, the base material that is a material having less absorbency for the light emitted from the light source 107 (light emitting element 105) and the wavelength conversion substance. Moistureproof coating or laminate may be performed as necessary.

Further, on a main surface of the wavelength converting member 113 on the light source 107 side may be formed a dichroic layer 115 which transmits a light emission wavelength of the light source 107 but reflects a light emission wavelength of the wavelength conversion substance. For example, the dichroic layer 115 is formed, which has a light reflectance higher for a wavelength range converted by the wavelength converting member 113 than for a light emission wavelength of the light source 107. Such a configuration can prevent the light emitted from the wavelength conversion substance from being absorbed in a member on the light source 107 side.

Wavelength Conversion Substance

The wavelength conversion substance is one that converts the wavelength of the light emitted from the light emitting element into a different wavelength. The wavelength conversion substance is contained in the wavelength converting member 113. The wavelength conversion substance can also be contained in the sealing member 106 described in the first embodiment. The wavelength conversion substance in the wavelength converting member 113 or the sealing member 106 may be provided more densely on the light source 107 or light emitting element 105 side, or may be disposed in a scattered manner.

Needless to say, one that can be excited by the light emitted from the light emitting element should be used as the wavelength conversion substance. Examples of the fluorescent material that can be excited by a blue light emitting element or an ultraviolet light emitting element include an yttrium-aluminum-garnet fluorescent material activated by cerium (Ce:YAG); a lutetium-aluminum-garnet fluorescent material activated by cerium (Ce:LAG); a nitrogen-containing calcium aluminosilicate fluorescent material activated by europium and/or chromium ($CaO—Al_2O_3—SiO_2$); a silicate fluorescent material activated by europium ($(Sr, Ba)_2SiO_4$); nitride fluorescent materials such as a β-sialon fluorescent material, a CASN fluorescent material, and a SCASN fluorescent material; a KSF fluorescent material ($K_2SiF_6$:Mn); and a sulfide fluorescent material and a quantum dot fluorescent material. Combination of these fluorescent materials with the blue light emitting element or the ultraviolet light emitting element enables production of light emitting devices of various colors (e.g., a white color-based light emitting device).

It is preferable to select a light emission wavelength of the light emitting element and a light emission wavelength of the wavelength conversion substance, in view of the fact that the spectrum emitted from the light emitting device preferably includes a spectrum having a 65% or more wavelength band of the whole visible light band to improve color reproducibility and color rendering.

Fourth Embodiment

Figure 8:
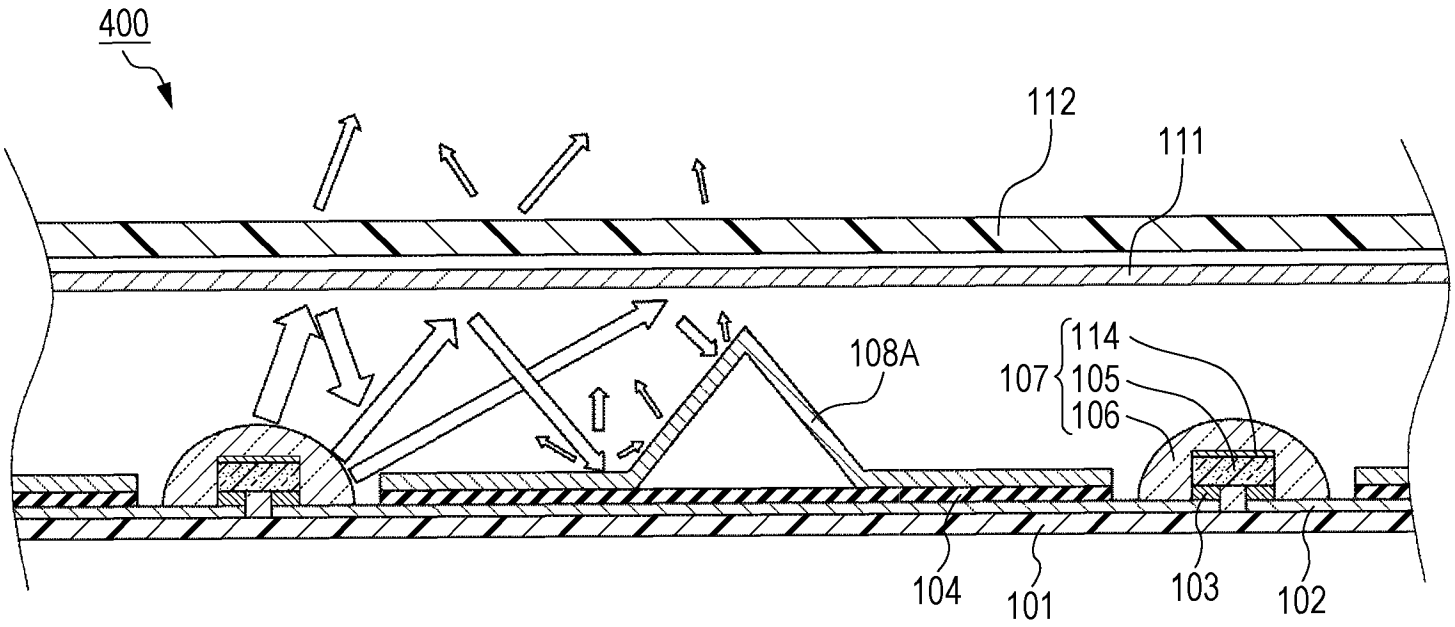
FIG. 8 is a schematic sectional view illustrating an example of a light emitting device according to a fourth embodiment.
Figure 9:
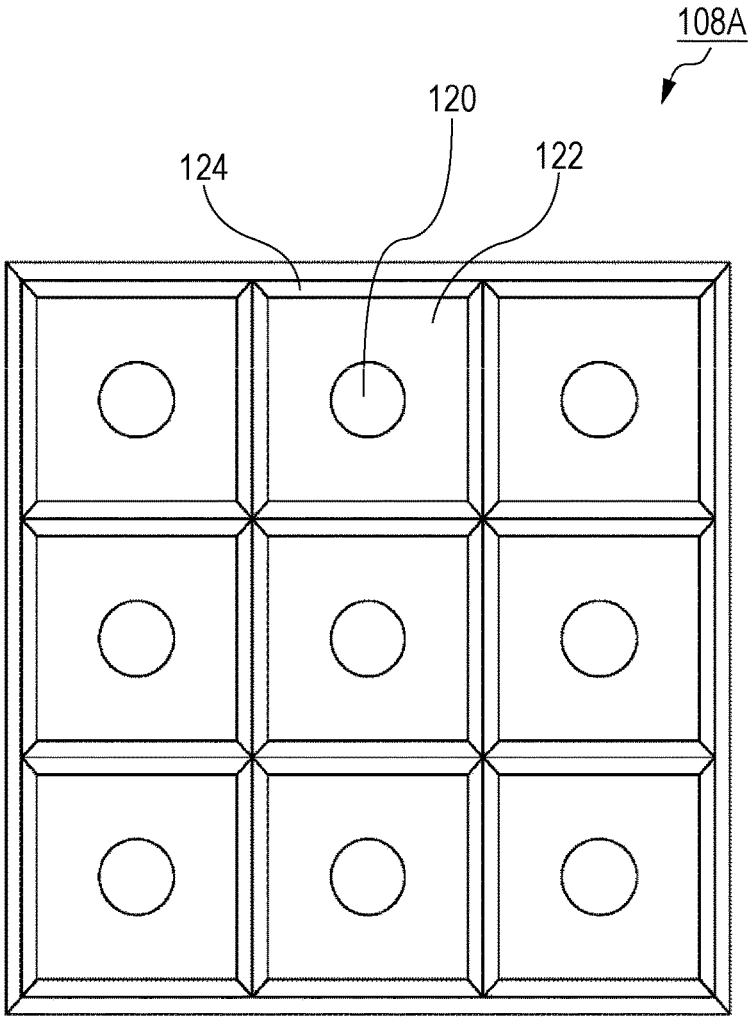
FIG. 9 is a schematic upper surface view illustrating an example of a light diffusing member.

FIG. 8 is a schematic sectional view illustrating an example of a light emitting device 400 according to a fourth embodiment. The light emitting device 400 is the same as the light emitting device in the first embodiment except that the shape of the light diffusing member 108 is different in the light emitting device 100 in the first embodiment, and the light emitting device 400 can give the same effect as that of the first embodiment. FIG. 9 is a schematic upper surface view of a light diffusing member 108A used in the present embodiment.

In the present embodiment, the light diffusing member 108A includes a plurality of recess portions each of which having a plain surface portion 122 that includes an opening 120 in which the light source 107 is disposed, and having a wall portion 124 surrounding the plain surface portion 122, as illustrated in FIGS. 8 and 9. The wall portion 124 to be a side surface of the recess portion is preferably slanted so as to broaden toward the upward.

According to the light emitting device of the present embodiment, because each of the light sources 107 is surrounded by each of the wall portion 124, the light emitted from an adjacent light source can be prevented from entering an adjacent region on the other side of the wall portion. Also, when the brightness is desired to be increased only in a predetermined region, this configuration enables the increase of the brightness only in the predetermined region while preventing light from entering an adjacent region.

The shape of the plain surface portion 122 can be set to, for example, a square as illustrated in FIG. 9. The shape of the plain surface portion 122 is not limited to a square, and may be a polygon such as a rectangle or a hexagon. The number of sections, or regions sectioned by the wall portion 124 can be set to any number according to the number of the light sources 107.

Examples of a method for molding the light diffusion member 108A include a molding method in which a mold is used, and a molding method by stereolithography. As the molding method in which a mold is used, there can be applied, for example, injection molding, extrusion molding, compression molding, vacuum forming, pressure forming, and press-forming. For example, a reflecting sheet formed from PET or the like can be subjected to vacuum molding to give the light diffusing member 108A in which the plain surface portion 122 and the wall portion 124 are integrally formed. The thickness of the reflecting sheet is, for example, 100 to 300 μm.

The uppermost part of the wall portion 124 of the light diffusing member 108A may or may not be in contact with the half mirror 111.

EXAMPLE 1

In the present example, a glass epoxy base substrate is used as a base 101, and a 35 μm Cu material is used as a conductor wiring line 102, as illustrated in FIG. 1. As an insulating member 104, an epoxy white solder resist is used.

A light source 107 includes a light emitting element 105 and a sealing member for covering the light emitting element 105, the light emitting element 105 having a 600 μm-side square shape in a planar view and having a 150 μm-thick nitride blue LED. A reflecting layer 114 is formed on the light emitting element 105 on a side of a light extraction surface opposite to the base 101, to reduce the amount of light emitted directly above the light emitting element, so that batwing light distribution characteristics are realized.

The light emitting element 105 is connected to the conductor wiring line 102 by solder as a bonding member 103, and a silicone resin is molded into a sealing member 106 to cover the light emitting element 105, the conductor wiring line 102, and the bonding member 103.

At this time, the light emitting element 105 is aligned in 5 lines×5 columns, total 25 elements at 12.5 mm pitches.

Further, 188 μm-thick white PET as a light diffusing member 108 is formed on an insulating member 104. A half mirror 111 having a reflectance of 60% is provided on the side of the light extraction surface for the light source 107, which is opposite to the base 101, at a distance of 2.5 mm from a surface of the base 101, and a light diffusing plate 112 is provided on the half mirror 111.

Figure 2:
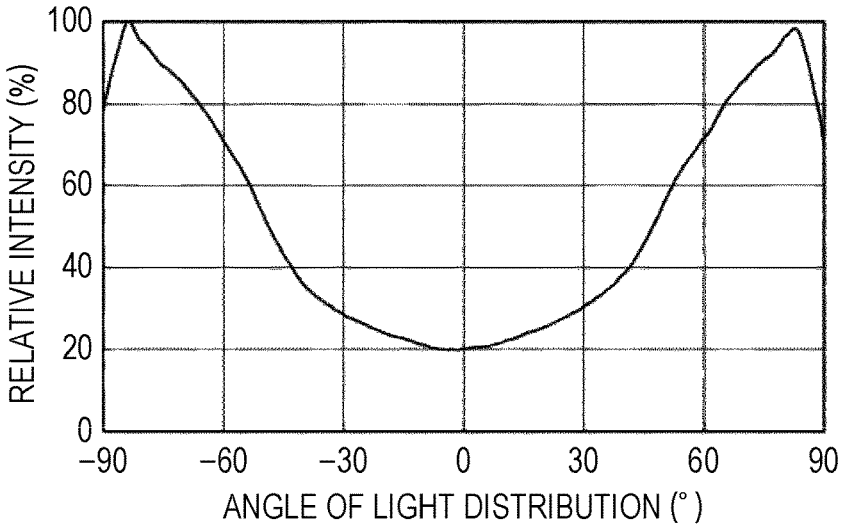
FIG. 2 is a graph of the light distribution characteristics of a light source in the embodiment.

FIG. 2 illustrates the light distribution characteristics of the light source 107 of Example 1. As is understood from FIG. 2, batwing light distribution characteristics are obtained, in which the brightness is low in an optical axis L direction and high on wide angle sides. At this time, the amount of light emitted at an elevation angle of less than 20° to a direction parallel to a mounting surface of the light source 107 is 30% or more of the whole amount of light.

The half mirror has an eight-layer configuration by repetition of a $SiO_2$ layer (80 nm) and a $ZrO_2$ layer (59 nm).

FIG. 3 illustrates the relationship between the spectral reflectance and the emission spectrum of the light emitting element 105 at this time.

Figure 4:
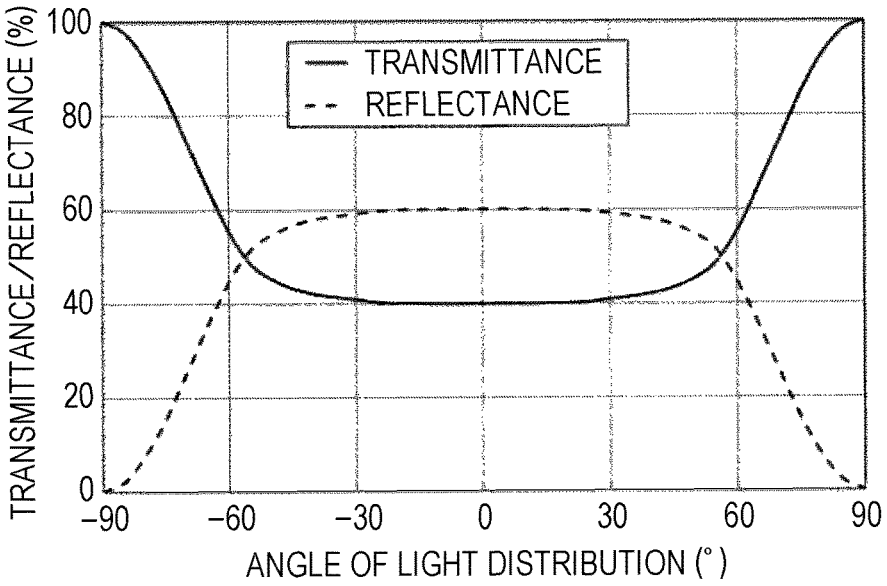
FIG. 4 is a graph illustrating the angle dependence of transmittance of the half mirror in the embodiment.

FIG. 4 illustrates the angle dependence of reflectance and transmittance of the half mirror 111 for the wavelength of the emission spectrum at this time.

With this configuration, about 60% of the light emitted from the light source 107 in the optical axis direction is reflected, and the amount of light reflected decreases with an increasing angle to form a wider angle, so that much more light reaches the light diffusing plate 112.

EXAMPLE 2

Example 2 is the same as Example 1 except that the light diffusing member 108 in Example 1 is changed to a mirror 110, and PICASUS 100GH10 manufactured by TORAY INDUSTRIES, INC. is used as the half mirror 111. An enhanced specular reflector (ESR) manufactured by 3M Japan Limited is used as a mirror. This sheet has a reflectance of 98%. This sheet doesn't have the angle dependence of transmittance.

Figure 6A:
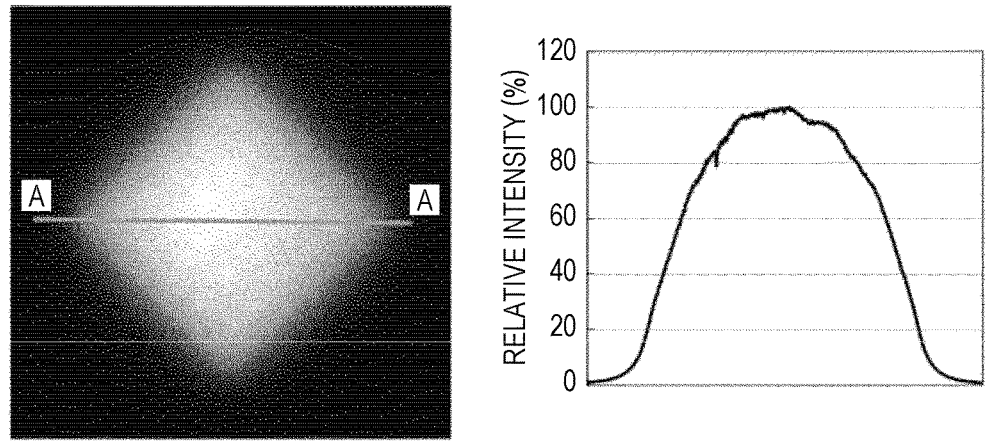
FIG. 6A is a photograph and a graph that illustrate the brightness distribution characteristics of a light emitting device according to Example 2.

FIG. 6A illustrates the result of observing, in this combination, the brightness unevenness from the light diffusing plate 112 side. The left view is a brightness unevenness observation photograph, and the right view is a graph obtained by measuring the brightness distribution at the line A-A.

Figure 6B:
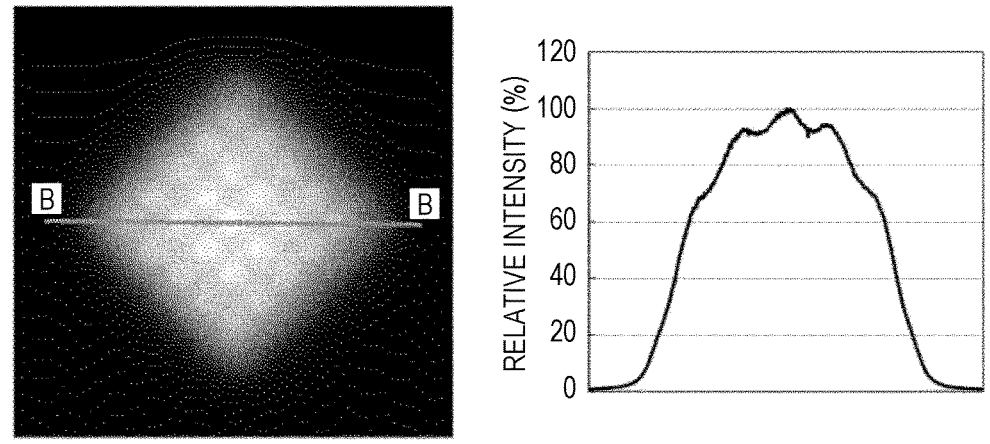
FIG. 6B is a photograph and a graph that illustrate the brightness distribution characteristics of a light emitting device according to a comparative example.

FIG. 6B illustrates by way of comparison the brightness unevenness after removal of the mirror 110 and the half mirror 111. As with FIG. 6A, the left view is a brightness unevenness observation photograph, and the right view is a graph obtained by measuring the brightness distribution at the line B-B. According to these photographs and graphs, it is understood that the uniformity of the brightness is improved compared to the case of not using the mirror 110 and the half mirror 111.

The light emitting device according to the embodiments can be used for a backlight light source for liquid crystal display device, various lighting apparatus, and so on.

Obviously, numerous modifications and variations of the present invention are possible in light of the above teachings. It is therefore to be understood that within the scope of the appended claims, the invention may be practiced otherwise than as specifically described herein.

What is claimed is:

1. A light emitting device comprising:

a base having a first side;

light sources mounted on the first side of the base;

a half mirror to reflect a part of incident light and to transmit another part of the incident light, the half mirror being disposed opposite to the first side of the base such that the light sources are provided between the half mirror and the first side; and a light reflecting layer provided on the first side except for the light sources on the first side.

2. The light emitting device according to claim 1, wherein each of the light sources includes an additional light reflecting layer on an upper surface of each of the light sources.

3. The light emitting device according to claim 2, wherein each of the light sources has bat wing light distribution characteristics.

4. The light emitting device according to claim 1, wherein, in the case where the light travels perpendicularly toward the half mirror, a first wavelength range in which a wavelength is more than or equal to a light emission peak wavelength of the light source and in which a reflectivity of the half mirror is larger than a reflectivity threshold is wider than a second wavelength range in which a wavelength is less than or equal to the light emission peak wavelength of the light source and in which the reflectivity of the half mirror is larger than the reflectivity threshold.

5. The light emitting device according to claim 1, wherein, in the case where the light travels perpendicularly toward the half mirror, the reflectivity of the half mirror ranges from 30 to 75% in a range of light emission wavelength of each of the light sources.

6. The light emitting device according to claim 1, wherein the light reflecting layer includes a dielectric multilayer film.

7. The light emitting device according to claim 6, wherein a thickness of the dielectric multilayer film is 0.3 mm or less.

8. The light emitting device according to claim 1, wherein a space between the half mirror and the base is 0.3 times or less a space between adjacent two light sources of the light sources.

9. The light emitting device according to claim 1, wherein an amount of light having an elevation angle of less than 20° to a direction parallel to a mounting surface of the light source is 30% or more of a whole amount of the light.

10. The light emitting device according to claim 1, wherein a wavelength converting member that absorbs light emitted from each of the light sources and emits light having a wavelength different from a wavelength of the light emitted from each of the light sources is formed on a light-emitting surface side of the light emitting device.

11. The light emitting device according to claim 10, wherein a dichroic layer that has a wavelength-converted light in a wavelength range converted by the wavelength converting member higher than a reflectance of wavelength converted light in a light emission wavelength of each of the light sources is disposed between the wavelength converting member and the half mirror.

12. The light emitting device according to claim 1, wherein the spectrum emitted from the light emitting device includes a spectrum having a 65% or more wavelength band of a whole visible light band.

13. The light emitting device according to claim 1, wherein each of the light sources includes a light emitting element and a lens that widely distributes light from the light emitting element.

14. The light emitting device according to claim 1, wherein the light reflecting layer includes a light diffusing member.

15. The light emitting device according to claim 14, wherein the half mirror has a reflectivity with respect to wavelengths of light emitted from the light sources, which decreases as an angle of incidence on the half mirror increases.

16. The light emitting device according to claim 15, wherein the reflectivity with respect to wavelengths of the light emitted from the light sources is substantially constant in a case where an absolute value of the angle of incidence is less than 30 degrees.

17. The light emitting device according to claim 1, wherein the half mirror comprises a dielectric multilayer film.

18. The light emitting device according to claim 1, wherein each of the light sources have a light emitting surface, and wherein the light reflecting layer having a light reflecting surface, at least a part of the light emitting surface is provided between the light reflecting surface and the half mirror.

19. The light emitting device according to claim 1, further comprising:

wall portions provided on the first side and surrounding the light sources, respectively.

20. The light emitting device according to claim 19, wherein the wall portions are made of the light reflecting layer.

* * * * *